United States Patent [19]

Heymanns

[11] 3,944,152

[45] Mar. 16, 1976

[54] REWINDING MACHINE FOR LONGITUDINALLY SLIT WEBS OF PAPER

[75] Inventor: Willi Heymanns, Hemmerden ub. Neuss, Germany

[73] Assignee: Jagenberg-Werke AG, Dusseldorf, Germany

[22] Filed: Dec. 10, 1974

[21] Appl. No.: 531,412

[30] Foreign Application Priority Data

Dec. 28, 1973 Germany ..... 2364974

[52] U.S. Cl. ..... 242/65

[51] Int. Cl.[2] ..... B65H 17/08

[58] Field of Search ..... 242/56.2, 56.4, 56.9, 65

[56] References Cited

UNITED STATES PATENTS

| | | | |
|---|---|---|---|
| 2,985,398 | 5/1961 | Rockstrom | 242/65 |
| 3,086,726 | 4/1963 | Aaron | 242/65 |
| 3,332,636 | 7/1967 | Rockstrom | 242/65 |
| 3,433,429 | 3/1969 | Schnitzspahn | 242/56.4 X |

*Primary Examiner*—Edward J. McCarthy
*Attorney, Agent, or Firm*—Burgess, Dinklage & Sprung

[57] ABSTRACT

The application relates to an improvement in a rewinding machine for continuous individual webs of paper cut from a wider web, and including a backing cylinder, a plurality of winding shafts alternately arranged diametrically opposite one another relative to the backing cylinder, a roll on each of the winding shafts, and bearing blocks for each of the rolls, whereby the individual webs contact the backing cylinder and alternate individual webs are taken up on the rolls arranged on the winding shafts on each side of the backing cylinder, the bearing blocks permitting the shafts and rolls to move away from the backing cylinder as the roll diameters increase due to webs wound thereon, all known in the art. In accordance with the invention, a bearing block on one side of the backing cylinder is coupled with a bearing block on the other side of the backing cylinder, the coupled bearing blocks constituting those which define a plane of division between two adjacent individual webs, and means are provided for displacing the coupled bearing blocks along the axis of the backing cylinder, whereby in adjusting the rewinding machine to accept individual webs of different widths by displacement of the bearing blocks on both sides of the backing cylinder, the coupling of the bearing blocks ensures that opposite blocks are properly aligned to define planes of division.

4 Claims, 2 Drawing Figures

REWINDING MACHINE FOR LONGITUDINALLY SLIT WEBS OF PAPER

Figure 1:
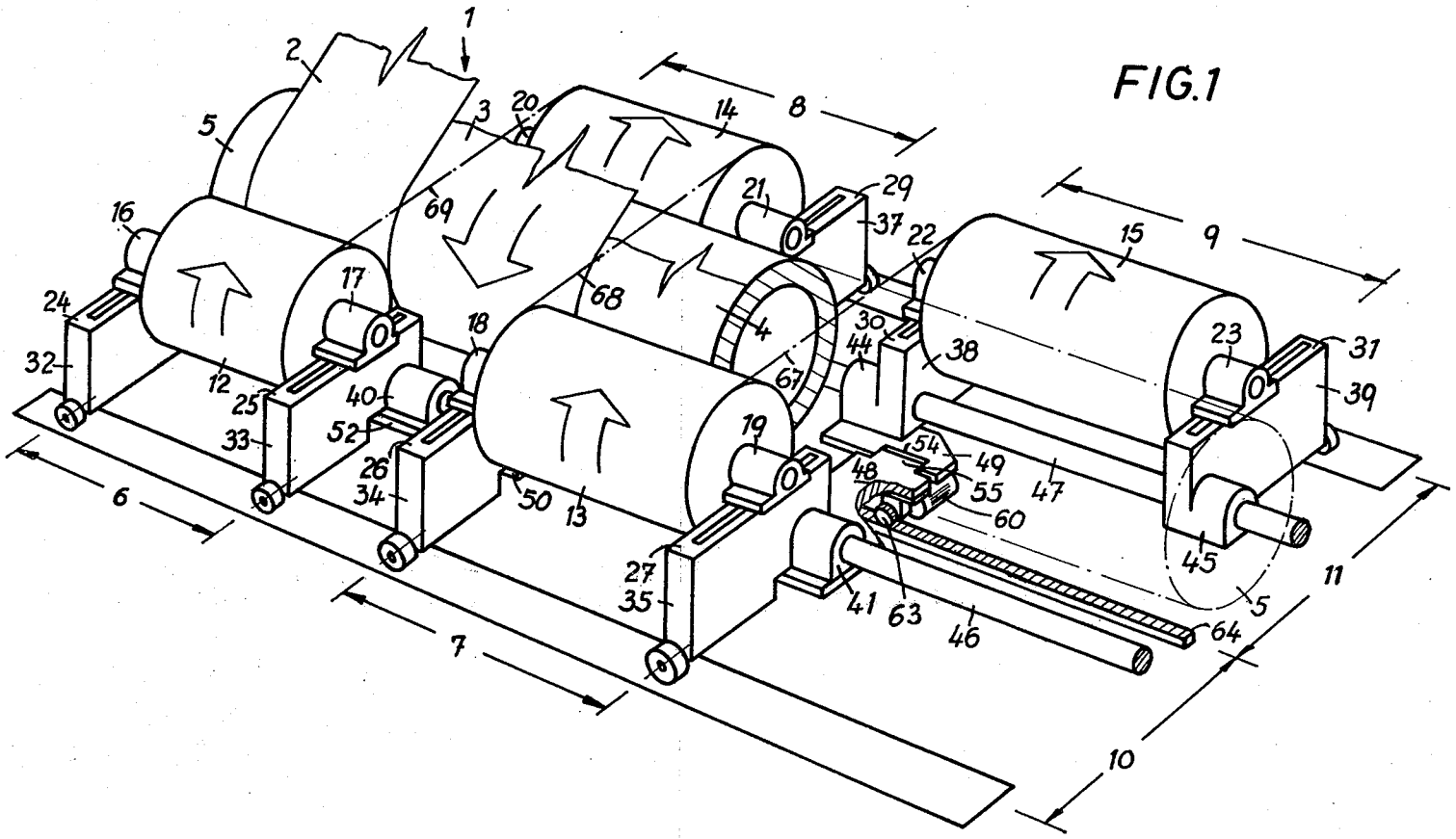

A roll cutting and rewinding machine of the above-described kind is a paper working machine by which a wide paper supply roll is divided in a single operation into a plurality of narrower individual rolls. The system used for rewinding the web which has been divided by a plurality of longitudinal slits is to provide a plurality of rewinding stations adjacent one another diametrically opposite a backing cylinder on either side thereof and parallel to the axis thereof. The individual rewinding stations consist of bearing blocks arranged in pairs, which are adjustable parallel to the backing cylinder according to the width of the roll to be wound and to the length thereof with respect to the total working width. This adjusting becomes necessary whenever the machine-width paper web coming from the supply roll is divided into individual rolls having new widths. For this purpose the slitting knives are first moved to their new position, thus creating the new planes of division. Every two adjacent individual webs produced by such slitting are likewise formed into adjacent individual rolls as they are wound, each having one end in the same common plane of division. Now, in order to produce proper paper rolls, a paper web, preferably passed around a backing cylinder and wound into a roll against the latter, must not undergo any lateral displacement, i.e., each pair of bearing blocks must occupy during the winding process a certain position in relation to its respective roll and also to the immediately adjacent roll on the other side of the backing cylinder.

Hitherto the bearing blocks have had to be adjusted individually upon every change in the web width. This means that the precise alignment of the individual bearing blocks was not possible until the roll core tubes were already mounted in place, on the one hand, and on the other hand the slit individual webs had been threaded in and had been glued to the alternately disposed roll core tubes. With the above-described setting-up procedure it becomes clear that, upon a change in the web width, a precise prealignment of the bearing blocks was not possible.

The invention is addressed to the problem of eliminating the existing deficiencies with respect to the readjustment of the bearing blocks when the web widths are changed, and of finding an apparatus by which the bearing blocks can be placed in their winding positions in a very short amount of time, without correction.

This problem is solved by the invention in that, in the initially described roll cutting and rewinding machine, bearing blocks located diametrically opposite the backing roll in the area of each plane of division are coupled together for common lateral adjustment, the coupling of the bearing blocks consisting of at least two matingly joined plates. Furthermore, the plates are of such construction that they are not displaceable with respect to one another in the direction of the adjustment of the bearing blocks but do permit a slight displacement transversely thereof. In further development of the roll cutting machine provision is made for the association of displacement driving means with only one of the bearing blocks. It is additionally proposed that the displacement of the bearing blocks be actuated simultaneously with the displacement of the slitting means for the division of the machine-width web into a plurality of narrower webs.

The advantages achieved with the invention consist especially in the fact that, due to the mechanical joining of the bearing blocks disposed opposite one another adjacent a plane of division, when only one of these blocks is displaced, the bearing block serving the adjacent paper roll located on the other side of the backing cylinder is displaced with it. In this manner the latter bearing block will always be in its proper location, thereby eliminating the time-consuming correction of the bearing blocks, so that immediately upon completion of the resetting operation a trouble-free winding operation can be started. It is also advantageous that, due to the coupling together of specific bearing blocks, the resetting time and the number of setting drives have been reduced by virtually one half. The invention offers a very special advantage in the fact that the coupled bearing blocks can be shifted by the shifting of the remotely adjustable slitting knives, i.e., the signals for the displacement of the slitting knives can serve simultaneously for the displacement of the associated bearing blocks.

Figure 2:
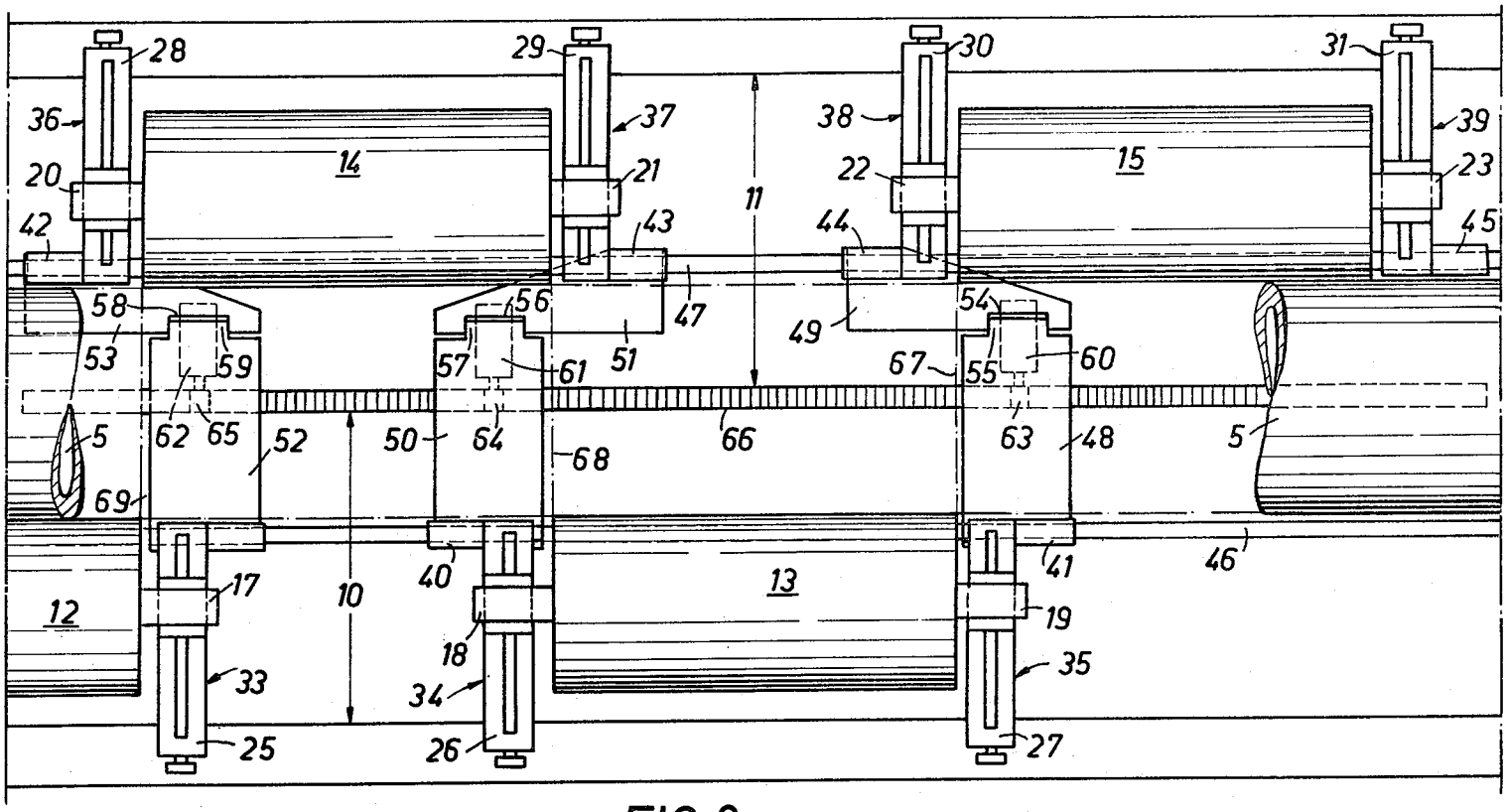

One illustrative embodiment of the invention is shown in the accompanying drawing wherein:

FIG. 1 is a perspective representation of the roll cutting machine having coupled bearing blocks, and FIG. 2 is a partial plan view of the roll cutting machine represented in FIG. 1.

As seen in FIG. 1, the paper web 1, which comes from a supply roll which is not shown, has already been divided by slitting knives, which also are not shown, into individual webs 2, 3 and 4. These individual webs pass around a backing cylinder 5 by alternately different degrees, which means that winding stations 10 and 11, each composed of a plurality of individual stations 6 and 7, and 8 and 9, respectively, are located one on each side of the backing cylinder 5. The rolls 12 and 13, and 14 and 15, respectively, which form in the individual stations 6 and 7, and 8 and 9, respectively, all have the same diameter and the same sense of rotation. They differ only in their widths, which correspond in each case to the widths of the individual webs 2–4. The rolls 12–15 are accommodated in bearings 16–23 which are displaceable radially of the backing cylinder 5 on flat guiding means 24–31 on the bearing blocks 32–39. For the lateral displacement of the bearing blocks 32–39, the latter are provided with slide bearings 40–45 which slide on round guides 46 and 47 disposed on either side of the backing cylinder 5. Furthermore, pairs of bearing blocks 33 and 36, 34 and 37, and 35 and 38, located on diametrically opposite sides of the backing cylinder 5, are coupled together by plates 52 and 53, 50 and 51, and 48 and 49, respectively. These plate pairs 48 and 49, 50 and 51, and 52 and 53 have on their common contact sides mating portions consisting of projections 55, 57 and 59, extending into the recesses 54, 56 and 58, respectively. In addition, on the undersides of plates 48, 50 and 52 there is disposed one displacement drive means each in the form of a gear motor 60, 61 and 62. These gear motors 60–62 have each a pinion 63–65 on their drive shaft, these pinions all meshing with a rack 66 affixed to the floor of the room. When the bearing blocks 33–35 are shifted by the gear motors 60–62, the oppositely located bearing blocks 36–38 are driven with them, without any free play, by the projections 55, 57 and 59 extending into recesses 54, 56 and 58, respectively, which means that the directly opposite bearing blocks 36–38 will also have assumed their proper position upon the end of the displacement. As best seen in FIG. 2, the mating portions 54 and 55, 56 and 57, and 58 and 59 permit a slight relative movement between the plate pairs 48–49, 50–51 and 52–53 transversely of the direction of displacement, this being necessary in the event of any possible lack of parallelism between the two round guides 46 and 47.

In further development of the subject matter of the invention, it is possible, in the case of remotely displaceable slitting knives, to use the displacement signals thereof simultaneously for the displacement of the coupled bearing blocks, whereby a maximum saving of time is achieved in addition to winding that is precise at the edges.

It will be appreciated that the instant specification and examples are set forth by way of illustration and not limitation, and that various modifications and changes may be made without departing from the spirit and scope of the present invention.

What is claimed is:

1. In a rewinding machine for continuous individual webs of paper or the like longitudinally cut from a wider web, including a backing cylinder, a plurality of winding shafts alternately arranged diametrically opposite one another relative to said backing cylinder, a plurality of rolls respectively on said winding shafts, and bearing blocks for each of said rolls, whereby said individual webs contact said backing cylinder and alternate individual webs are taken up on the rolls arranged on the winding shafts on each side of the backing cylinder, the bearing blocks permitting said shafts and rolls to move away from said backing cylinder as the roll diameters increase due to webs wound thereon, the improvement which comprises means coupling a bearing block on one side of said backing cylinder with a bearing block on the other side of said backing cylinder, the coupled bearing blocks constituting those which define a plane of division between two adjacent individual webs, and means for displacing said coupled bearing blocks along the axis of said backing cylinder, whereby in adjusting the rewinding machine to accept individual webs of different widths by displacement of the bearing blocks on both sides of the backing cylinder the coupling of the bearing blocks will ensure that opposite blocks are properly aligned to define planes of division.

2. A rewinding machine according to claim 1, wherein said coupling means each comprises a plate connected to each bearing block and means joining said plates.

3. A rewinding machine according to claim 2, wherein the plates are joined to one another so as to have play relative to one another perpendicularly to the axis of the backing cylinder but not parallel thereto.

4. A rewinding machine according to claim 1, including means for driving only one of each coupled pair of bearing blocks along the axis of said backing cylinder, coupling ensuring that the other of each coupled pair also is driven, thereby maintaining the planes of division.

* * * * *